US007954173B2

(12) United States Patent
Collier

(10) Patent No.: US 7,954,173 B2
(45) Date of Patent: Jun. 7, 2011

(54) VENTED APPAREL, VENT SYSTEMS AND ASSOCIATED METHODS

(75) Inventor: John J. Collier, Boulder, CO (US)

(73) Assignee: PRL USA Holdings, Inc., New York, NY (US)

( * ) Notice: Subject to any disclaimer, the term of this patent is extended or adjusted under 35 U.S.C. 154(b) by 1034 days.

(21) Appl. No.: 11/757,106

(22) Filed: Jun. 1, 2007

(65) Prior Publication Data

US 2008/0184454 A1 Aug. 7, 2008

Related U.S. Application Data

(60) Provisional application No. 60/887,963, filed on Feb. 2, 2007.

(51) Int. Cl.
*A41D 1/00* (2006.01)

(52) U.S. Cl. ..... 2/93; 2/85; 2/97; 2/108

(58) Field of Classification Search ..... 2/93, 97, 2/87, 84, 85, 108, 69, 227
See application file for complete search history.

(56) References Cited

U.S. PATENT DOCUMENTS 3,153,793 A * 10/1964 Lepore ..... 2/93
4,194,041 A 3/1980 Gore et al.
4,722,099 A * 2/1988 Kratz ..... 2/79
5,845,336 A * 12/1998 Golde ..... 2/93
6,163,883 A * 12/2000 Hong ..... 2/69
6,339,845 B1 1/2002 Burns et al.
6,742,225 B2 * 6/2004 Marty et al. ..... 24/382
6,792,621 B2 * 9/2004 Braun ..... 2/93
7,017,191 B2 * 3/2006 Golde ..... 2/93
7,171,695 B2 * 2/2007 Braun ..... 2/93
2003/0177616 A1 * 9/2003 Petravic et al. ..... 24/415
2006/0041990 A1 3/2006 Alesina et al.
2008/0040832 A1 * 2/2008 Bay ..... 2/93
2009/0077710 A1 * 3/2009 Bay ..... 2/87

OTHER PUBLICATIONS

UTS, Sealed Adjustments System, dated 2003 (1 page).

* cited by examiner

*Primary Examiner* — Gary L Welch
*Assistant Examiner* — Alissa J Tompkins
(74) *Attorney, Agent, or Firm* — Greenberg Traurig, LLP

(57) ABSTRACT

One embodiment of the present invention provides a vented apparel, comprising: an outer shell; an inner liner disposed adjacent at least a portion of an inside of the outer shell; a vent through the outer shell, wherein the vent is substantially covered by a screen; a zipper on the inner liner; and an adjusting mechanism on the outer shell; wherein the adjusting mechanism is connected to the zipper in order to move the zipper between a closed position and an open position. Another embodiment of the present invention provides a vent system, comprising: a vent through an outer shell of an item incorporating the vent system, wherein the vent is substantially covered by a screen; a zipper on an inner liner of the item, wherein the inner liner is disposed adjacent at least a portion of an inside of the outer shell; and an adjusting mechanism on the outer shell; wherein the adjusting mechanism is connected to the zipper in order to move the zipper between a closed position and an open position.

18 Claims, 11 Drawing Sheets

VENTED APPAREL, VENT SYSTEMS AND ASSOCIATED METHODS

RELATED APPLICATIONS

This application claims the benefit of U.S. Provisional Application Ser. No. 60/887,963, filed Feb. 2, 2007, which is incorporated herein by reference in its entirety.

FIELD OF THE INVENTION

The present invention relates to vented apparel, vent systems and associated methods.

For the purposes of describing and claiming the present invention the term "zipper" is intended to include (but not be limited to): (a) a closure mechanism operated by a slide that engages/disengages respective teeth from two opposing rows of teeth (see, e.g., FIG. 17 showing a zipper with a first row of teeth labeled "A" and a second row of teeth labeled "B"); and (b) a closure mechanism operated by a slide that engages/disengages opposing linear mating strips (such as ZIPLOC-type closures).

Further, for the purposes of describing and claiming the present invention the term "screen" is intended to refer to a material that allows more air flow therethrough than the material into which the screen is affixed (e.g., a screen covering a vent in an outer shell would allow more air flow through the screen than would be allowed through the outer shell).

Further still, for the purposes of describing and claiming the present invention the term "inner liner" is intended to refer to a material that is disposed adjacent an inside of outer shell. In one example, the inner liner may be disposed adjacent essentially the entire inside of the outer shell. In another example, the inner liner may be disposed adjacent less than the entire inside of the outer shell.

Further still, for the purposes of describing and claiming the present invention the term "adjusting mechanism" is intended to refer to a mechanism that is connected to a zipper slide to move the zipper slide in order to open and close a zipper (in one specific example, the adjusting mechanism may also be a zipper).

Further still, for the purposes of describing and claiming the present invention the term "exposed" is intended to refer to being visible. In one example, a screen that is at least partially exposed may be at least partially visible to someone looking at the screen from the outside of an outer shell (see, e.g., FIG. 1 showing exposed screens).

Further still, for the purposes of describing and claiming the present invention the term "substantially prohibits air from flowing through the vent and the screen between the outside of the outer shell and the inside of the inner liner" is intended to refer to allowing essentially no more air from flowing through the vent and the screen to the inside of the inner liner than would be allowed by the material of the inner liner.

Further still, for the purposes of describing and claiming the present invention the term "the zipper moves between the closed position and the open position without creating an opening in the outer shell" is intended to refer: (a) in the case of a zipper with teeth, to not creating an opening larger than any opening between adjacent teeth or larger than any opening between the slide and any of the teeth; and (b) in the case of a zipper without teeth (such as ZIPLOC-type closures), to not creating an opening larger than any opening between the slide and the linear mating strips.

Further still, for the purposes of describing and claiming the present invention the term "water resistant" is intended to refer to passing at least one of the "Tests For Waterprooffness" described in U.S. Pat. No. 4,194,041 entitled "Waterproof Laminate" and issued in the name of Gore et al. (the entire disclosure of which is hereby incorporated by reference).

BACKGROUND OF THE INVENTION

Various vented garments have been proposed. Examples include what is disclosed in the following patent publications: U.S. Pat. No. 7,171,695 in the name of Braun (entitled Ventilated Garment With Vent Opening System); U.S. Pat. No. 6,339,845 in the name of Burns, et al. (entitled Wearing Apparel With Venting Apparatus); and United States Patent Application 2006/0041990 in the name of Alesina, et al. (entitled Garment With A Venting Structure And Method Of Using The Same)

SUMMARY OF THE INVENTION

One embodiment of the present invention provides a vented apparel, comprising: an outer shell; an inner liner disposed adjacent at least a portion of an inside of the outer shell; a vent through the outer shell, wherein the vent is substantially covered by a screen; a zipper on the inner liner; and an adjusting mechanism on the outer shell; wherein the adjusting mechanism is connected to the zipper in order to move the zipper between a closed position and an open position; wherein the zipper, in the open position, permits air to flow through the vent and the screen between an outside of the outer shell and an inside of the inner liner; wherein the zipper, in the closed position, substantially prohibits air from flowing through the vent and the screen between the outside of the outer shell and the inside of the inner liner; wherein the adjusting mechanism is configured to be actuated to move the zipper between the closed position and the open position; wherein the zipper moves between the closed position and the open position without creating an opening in the outer shell; and wherein the screen is at least partially exposed regardless of whether the zipper is in the open position or the closed position and regardless of a position of the adjusting mechanism.

In one example, the apparel may be selected from the group including (but not limited to): (a) a jacket; (b) a coat; (c) a pair of pants, (d) a shirt; (e) a glove; (f) a hat; and (g) a hood.

In another example, the adjusting mechanism may be a second zipper.

In another example, the second zipper may comprise a slide, a first row of teeth and a second row of teeth, the first row of teeth and the second row of teeth may be substantially all interconnected when the slide is at a first end of the second zipper, the first row of teeth and the second row of teeth may be substantially all interconnected when the slide is at a second end of the second zipper, and movement of the slide along the length of the second zipper from one side to the other may result in the first row of teeth and the second row of teeth remaining substantially all interconnected.

In another example, the zipper may be water resistant in the closed position.

In another example, the zipper may be formed from a material selected from the group including (but not limited to): (a) metal; and (b) plastic.

In another example, the second zipper may be water resistant regardless of the position of the slide of the second zipper.

In another example, the second zipper may be formed from a material selected from the group including (but not limited to): (a) metal; and (b) plastic.

In another example, the screen may be a perforated nylon fabric.

In another example, the vented apparel may further comprise a vent back disposed between the screen and the zipper for directing the air to flow through the vent and the screen between an outside of the outer shell and an inside of the inner liner.

In another embodiment of the present invention a vented apparel is provided, comprising: an outer shell; an inner liner disposed adjacent at least a portion of an inside of the outer shell; a vent through the outer shell, wherein the vent is substantially covered by a screen; a zipper on the inner liner; and an adjusting mechanism on the outer shell; wherein the adjusting mechanism is connected to the zipper in order to move the zipper between a closed position and an open position; wherein the zipper, in the open position, permits air to flow through the vent and the screen between an outside of the outer shell and an inside of the inner liner; wherein the zipper, in the closed position, substantially prohibits air from flowing through the vent and the screen between the outside of the outer shell and the inside of the inner liner; wherein the adjusting mechanism is configured to be actuated to move the zipper between the closed position and the open position without the adjusting mechanism creating an opening in the outer shell; wherein the adjusting mechanism is a second zipper comprising a slide, a first row of teeth and a second row of teeth, wherein the first row of teeth and the second row of teeth are substantially all interconnected when the slide is at a first end of the second zipper, wherein the first row of teeth and the second row of teeth are substantially all interconnected when the slide is at a second end of the second zipper, and wherein movement of the slide along the length of the second zipper from one side to the other results in the first row of teeth and the second row of teeth remaining substantially all interconnected; and wherein the screen is at least partially exposed regardless of whether the zipper is in the open position or the closed position and regardless of a position of the adjusting mechanism.

In one example, the apparel may be selected from the group including (but not limited to): (a) a jacket; (b) a coat; (c) a pair of pants, (d) a shirt; (e) a glove; (f) a hat; and (g) a hood.

In another example, the zipper may be water resistant in the closed position.

In another example, the zipper may be formed from a material selected from the group including (but not limited to): (a) metal; and (b) plastic.

In another example, the second zipper may be water resistant regardless of the position of the slide of the second zipper.

In another example, the second zipper may be formed from a material selected from the group including (but not limited to): (a) metal; and (b) plastic.

In another example, the screen may be a perforated nylon fabric.

In another example, the apparel may further comprise a vent back disposed between the screen and the zipper for directing the air to flow through the vent and the screen between an outside of the outer shell and an inside of the inner liner.

In another embodiment of the present invention a vent system is provided, comprising: a vent through an outer shell of an item incorporating the vent system, wherein the vent is substantially covered by a screen; a zipper on an inner liner of the item, wherein the inner liner is disposed adjacent at least a portion of an inside of the outer shell; and an adjusting mechanism on the outer shell; wherein the adjusting mechanism is connected to the zipper in order to move the zipper between a closed position and an open position; wherein the zipper, in the open position, permits air to flow through the vent and the screen between an outside of the outer shell and an inside of the inner liner; wherein the zipper, in the closed position, substantially prohibits air from flowing through the vent and the screen between the outside of the outer shell and the inside of the inner liner; wherein the adjusting mechanism is configured to be actuated to move the zipper between the closed position and the open position; wherein the zipper moves between the closed position and the open position without creating an opening in the outer shell; and wherein the screen is at least partially exposed regardless of whether the zipper is in the open position or the closed position and regardless of a position of the adjusting mechanism.

In one example, the item may be selected from the group including (but not limited to): (a) a piece of luggage; (b) a tent; (c) a sleeping bag; and (d) a helmet.

In another example, the adjusting mechanism may be a second zipper.

In another example, the second zipper may comprise a slide, a first row of teeth and a second row of teeth, wherein the first row of teeth and the second row of teeth may be substantially all interconnected when the slide is at a first end of the second zipper, wherein the first row of teeth and the second row of teeth may be substantially all interconnected when the slide is at a second end of the second zipper, and wherein movement of the slide along the length of the second zipper from one side to the other may result in the first row of teeth and the second row of teeth remaining substantially all interconnected.

In another example, the zipper may be water resistant in the closed position.

In another example, the zipper may be formed from a material selected from the group including (but not limited to): (a) metal; and (b) plastic.

In another example, the second zipper may be water resistant regardless of the position of the slide of the second zipper.

In another example, the second zipper may be formed from a material selected from the group including (but not limited to): (a) metal; and (b) plastic.

In another example, the screen may be a perforated nylon fabric.

In another example, a vent back may be disposed between the screen and the zipper for directing the air to flow through the vent and the screen between an outside of the outer shell and an inside of the inner liner.

In another embodiment of the present invention a vent system is provided, comprising: a vent through an outer shell of an item incorporating the vent system, wherein the vent is substantially covered by a screen; a zipper on an inner liner of the item, wherein the inner liner is disposed adjacent at least a portion of an inside of the outer shell; and an adjusting mechanism on the outer shell; wherein the adjusting mechanism is connected to the zipper in order to move the zipper between a closed position and an open position; wherein the zipper, in the open position, permits air to flow through the vent and the screen between an outside of the outer shell and an inside of the inner liner; wherein the zipper, in the closed position, substantially prohibits air from flowing through the vent and the screen between the outside of the outer shell and the inside of the inner liner; wherein the adjusting mechanism is configured to be actuated to move the zipper between the closed position and the open position without the adjusting mechanism creating an opening in the outer shell; wherein the adjusting mechanism is a second zipper comprising a slide, a first row of teeth and a second row of teeth, wherein the first row of teeth and the second row of teeth are substantially all interconnected when the slide is at a first end of the second zipper, wherein the first row of teeth and the second row of teeth are substantially all interconnected when the slide is at a second end of the second zipper, and wherein movement of the slide along the length of the second zipper from one side to the other results in the first row of teeth and the second row of teeth remaining substantially all interconnected; and wherein the screen is at least partially exposed regardless of whether the zipper is in the open position or the closed position and regardless of a position of the adjusting mechanism.

In one example, the item may be selected from the group including (but not limited to): (a) a piece of luggage; (b) a tent; (c) a sleeping bag; and (d) a helmet.

In one example, the zipper may be water resistant in the closed position.

In another example, the zipper may be formed from a material selected from the group including (but not limited to): (a) metal; and (b) plastic.

In another example, the second zipper may be water resistant regardless of the position of the slide of the second zipper.

In another example, the second zipper may be formed from a material selected from the group including (but not limited to): (a) metal; and (b) plastic.

In another example, the screen may be a perforated nylon fabric.

In another example, a vent back may be disposed between the screen and the zipper for directing the air to flow through the vent and the screen between an outside of the outer shell and an inside of the inner liner.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

Figure 1:
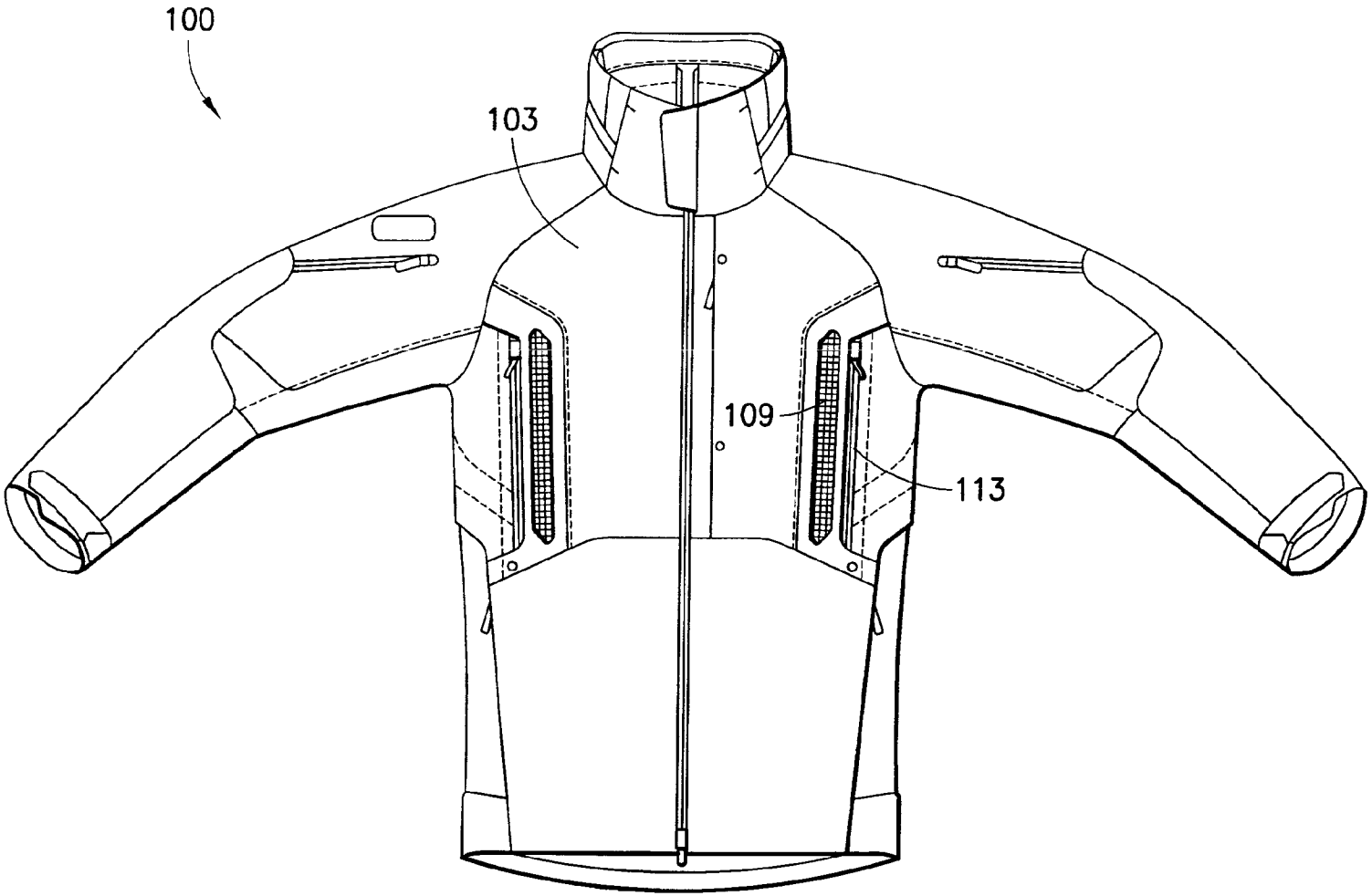
FIG. 1 shows a front view of a vented jacket according to one embodiment of the present invention.
Figure 2:
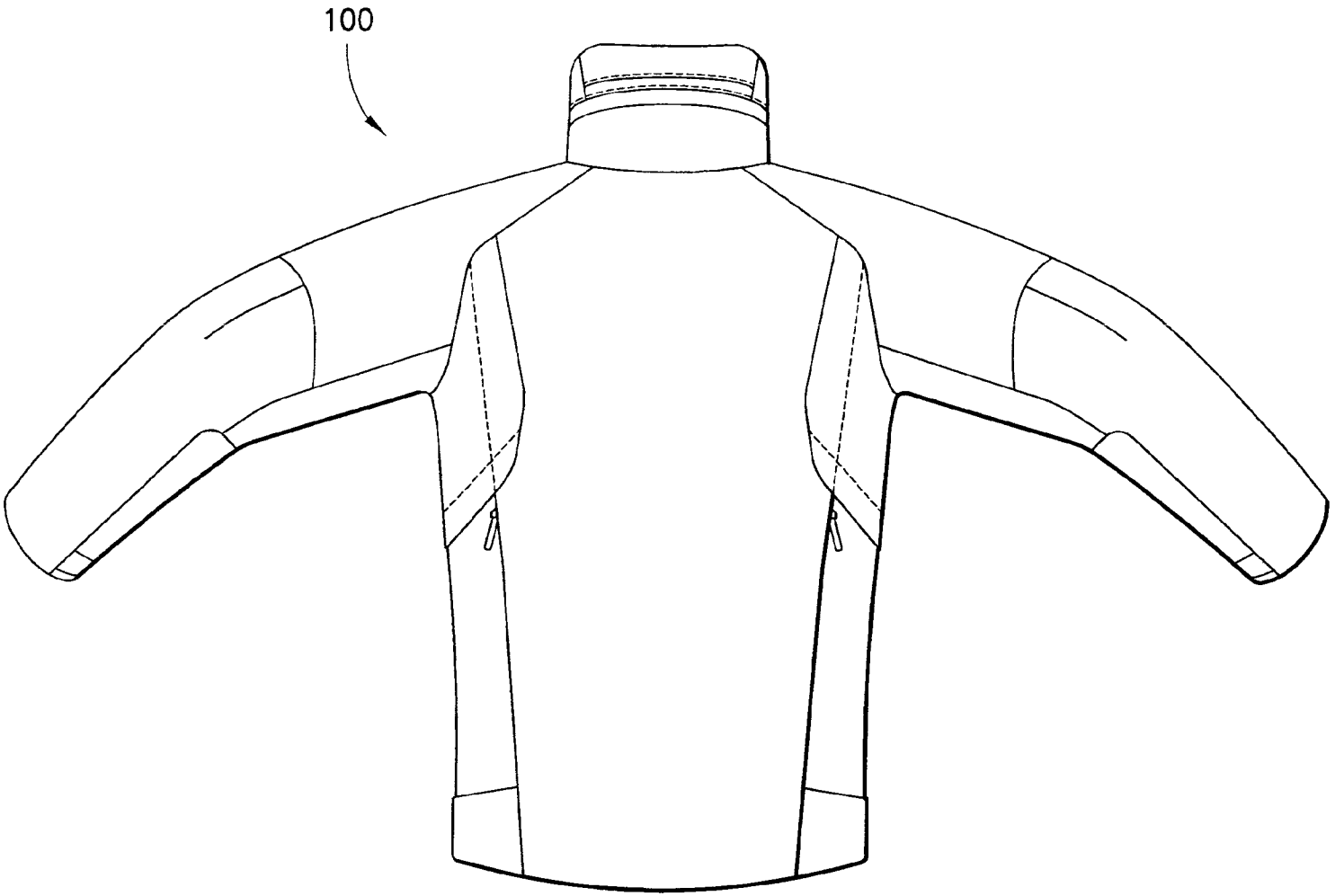
FIG. 2 shows a rear view of the vented jacket of FIG. 1.
Figure 22:
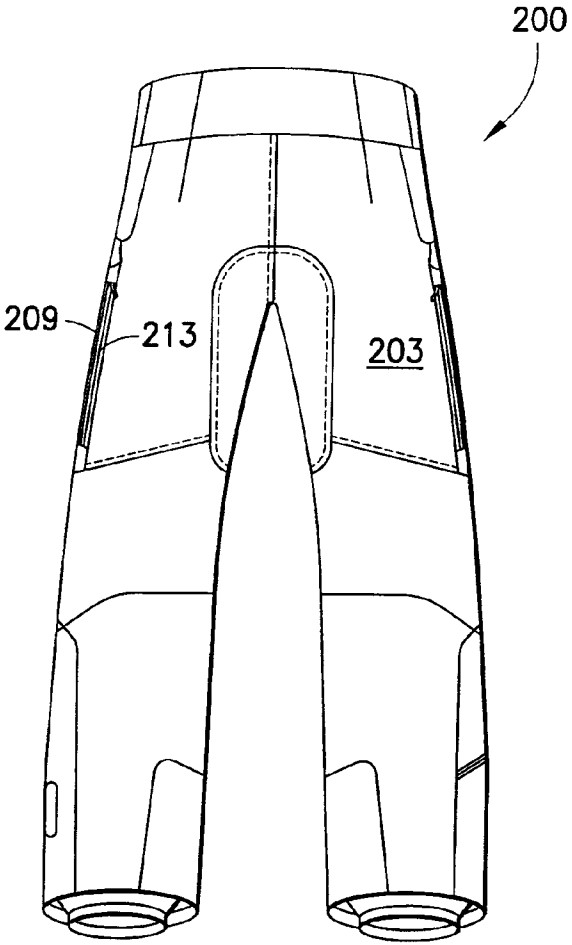
FIG. 22 shows a rear view of the vented pair of pants of FIG. 21.

Referring now to FIGS. 1-20, various views of a vented jacket according to an embodiment of the present invention are shown. As seen in these Figs., jacket 100 may include outer shell 103 and inner liner 105 disposed adjacent at least a portion of an inside of outer shell 103. Vent 107 may be provided through outer shell 103, wherein vent 107 is substantially covered by screen 109. Further, zipper 111 may be provided on inner liner 105 and adjusting mechanism 113 may be provided on outer shell 103 (of note, each element of a venting assembly of this embodiment comprising vent 107, screen 109, zipper 111 and adjusting mechanism 113 are identified herein by callout numbers—however, any desired number of venting assemblies may be utilized (see, for example, FIG. 1 depicting the front of the jacket having a left hand side venting assembly and a right hand side venting assembly and FIGS. 21 and 22 depicting a pair of pants having a left hand side venting assembly and a right hand side venting assembly).

Adjusting mechanism 113 may be connected (e.g., via a metal or plastic clip, loop, hook, ring or the like) to zipper 111 (e.g., to a slide or puller of zipper 111) in order to move the zipper 111 between a closed position and an open position; zipper 111, in the open position, may permit air to flow through vent 107 and screen 109 between an outside of outer shell 103 and an inside of inner liner 105; zipper 111, in the closed position, may substantially prohibit air from flowing through vent 107 and screen 109 between the outside of outer shell 103 and the inside of inner liner 105; adjusting mechanism 113 may be configured to be actuated to move zipper 111 between the closed position and the open position; zipper 111 may move between the closed position and the open position without creating an opening in outer shell 103; and screen 109 may be at least partially exposed regardless of whether zipper 111 is in the open position or the closed position and regardless of a position of adjusting mechanism 113.

In one example, adjusting mechanism 113 may be a second zipper. In another more specific example, the second zipper may comprise a slide, a first row of teeth and a second row of teeth (in which case the slide of the second zipper may be connected to the slide or puller of zipper 111). The first row of teeth and the second row of teeth may be substantially all interconnected when the slide is at a first end of second zipper, the first row of teeth and the second row of teeth may be substantially all interconnected when the slide is at a second end of the second zipper, and movement of the slide along the length of the second zipper from one side to the other may result in the first row of teeth and the second row of teeth remaining substantially all interconnected.

In another example, zipper 111 may be water resistant in the closed position.

In another example, zipper 111 may be formed from a material selected from the group including (but not limited to): (a) metal; and (b) plastic.

In another example, the second zipper may be water resistant regardless of the position of the slide of the second zipper.

In another example, the second zipper may be formed from a material selected from the group including (but not limited to): (a) metal; and (b) plastic.

In another example, screen 109 may be a perforated nylon fabric.

In another example, vent back 115 may be disposed between screen 109 and zipper 111 for directing the air to flow through vent 107 and screen 109 between an outside of outer shell 103 and an inside of inner liner 105.

In another example, adjusting mechanism 113 may be configured to be actuated to move zipper 111 between the closed position and the open position without adjusting mechanism 113 creating an opening in the outer shell.

Figure 3:
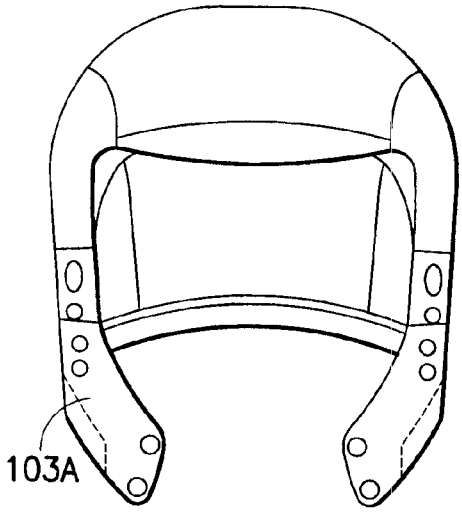
FIG. 3 shows a front view of a removable hood that may be utilized in connection with the vented jacket of FIG. 1.
Figure 4:
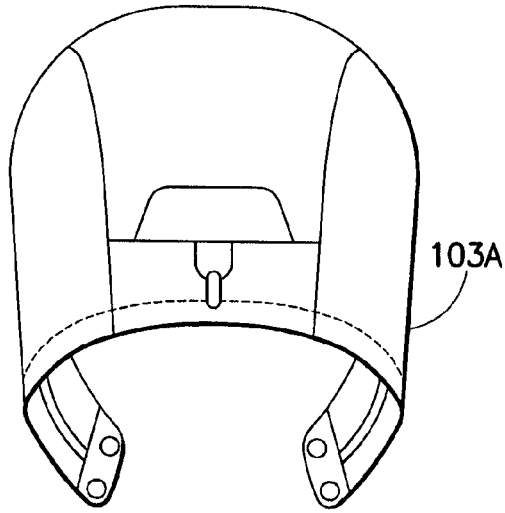
FIG. 4 shows a rear view of the removable hood of FIG. 3.
Figure 5:
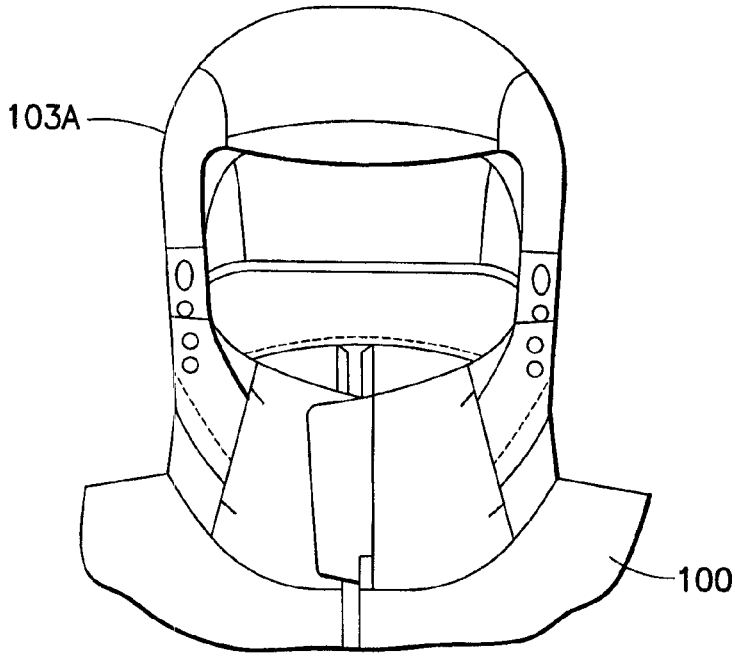
FIG. 5 shows a front view of the removable hood of FIG. 3 as attached to the vented jacket of FIG. 1.
Figure 6:
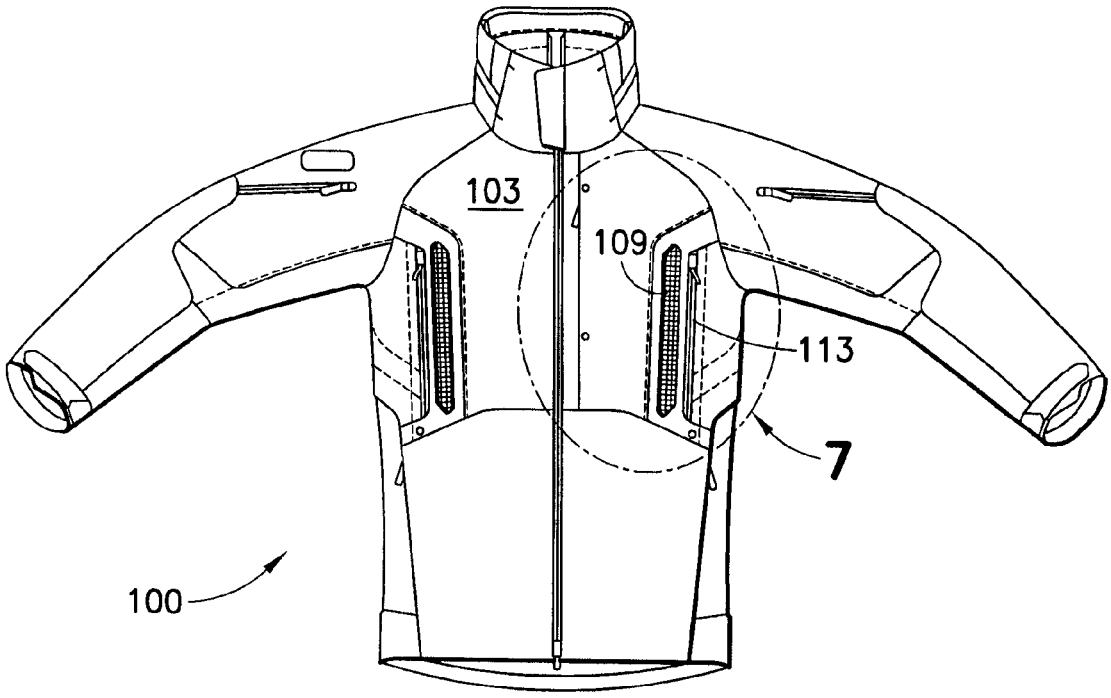
FIG. 6 show another front view of the vented jacket of FIGS. 1 and 2.
Figure 7:
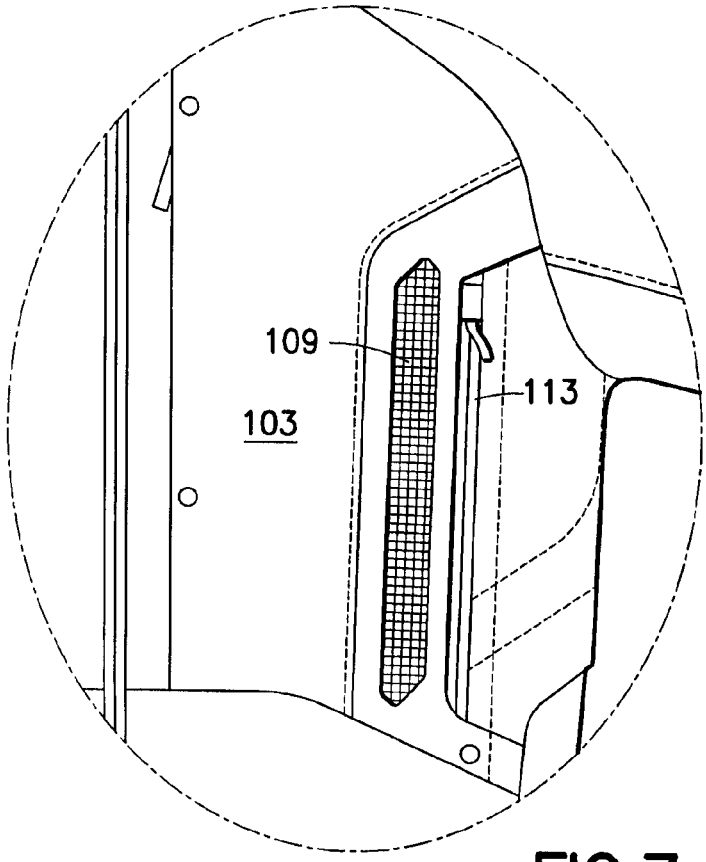
FIG. 7 shows certain details of one of the venting assemblies of the vented jacket of FIG. 6.
Figure 8A:
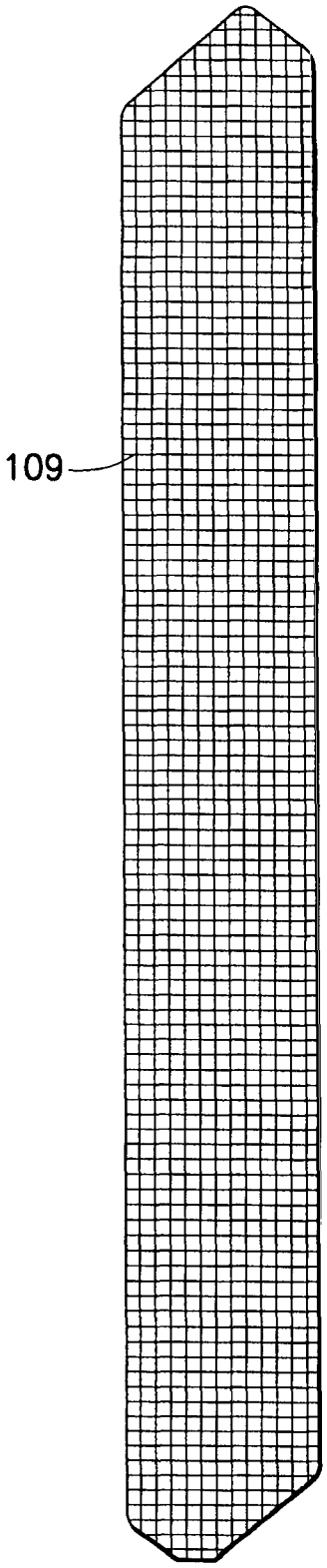
FIG. 8A shows an example shape for a screen (wearer's left) for use with a vented jacket according to an embodiment of the invention.
Figure 8B:
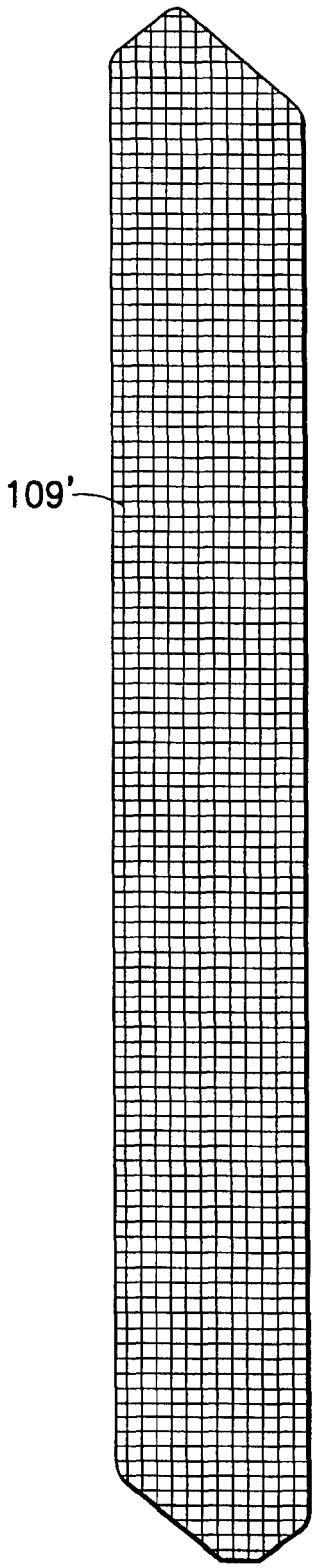
FIG. 8B shows an example shape for a screen (wearer's right) for use with a vented jacket according to an embodiment of the invention.
Figure 10:
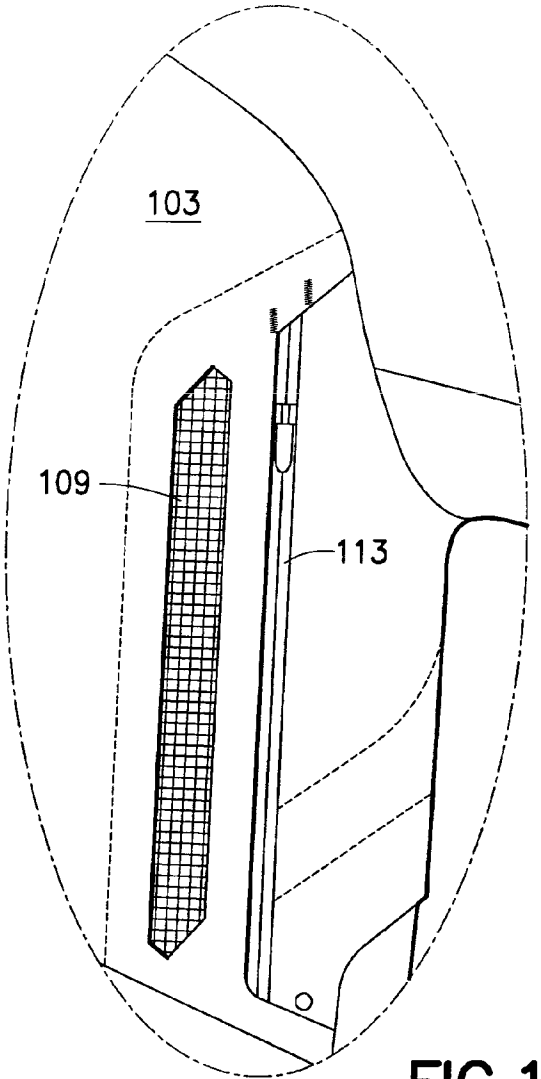
FIG. 10 shows certain details of one of the venting assemblies of the vented jacket of FIG. 9.
Figure 9:
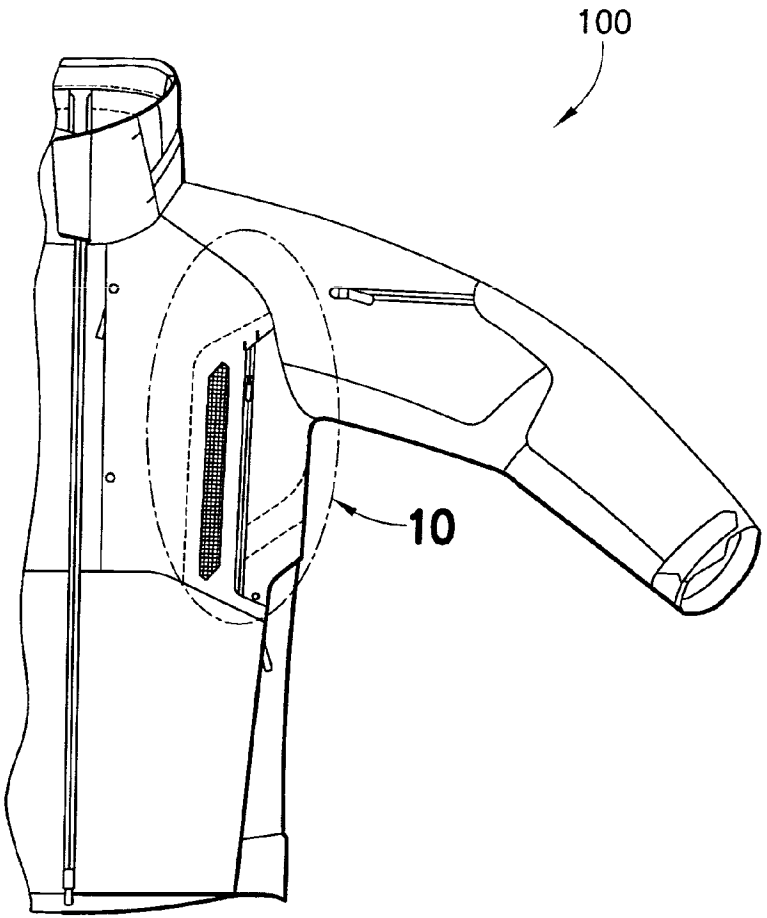
FIG. 9 shows another front view of the vented jacket of FIGS. 1 and 2.
Figure 11:
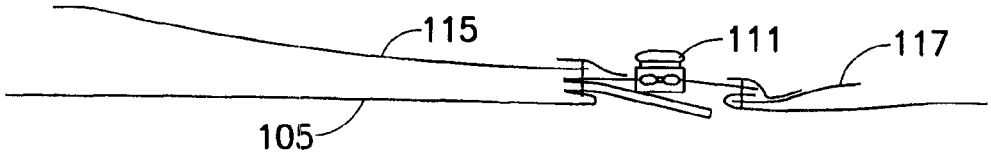
FIGS. 11-15 show certain details of an assembly method associated with one of the venting assemblies of the vented jacket of FIG. 9.
Figure 12:
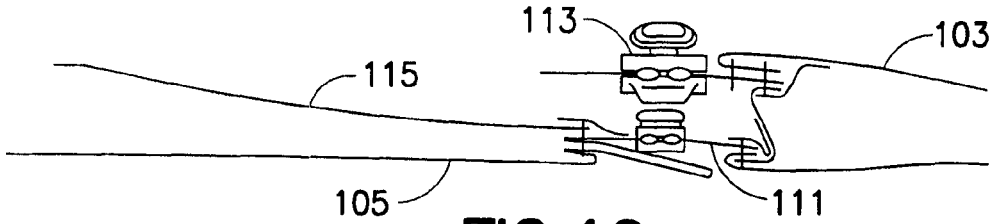
Figure 13:
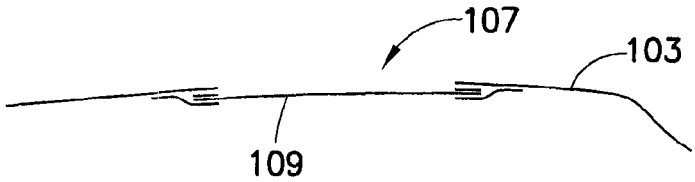
Figure 14:
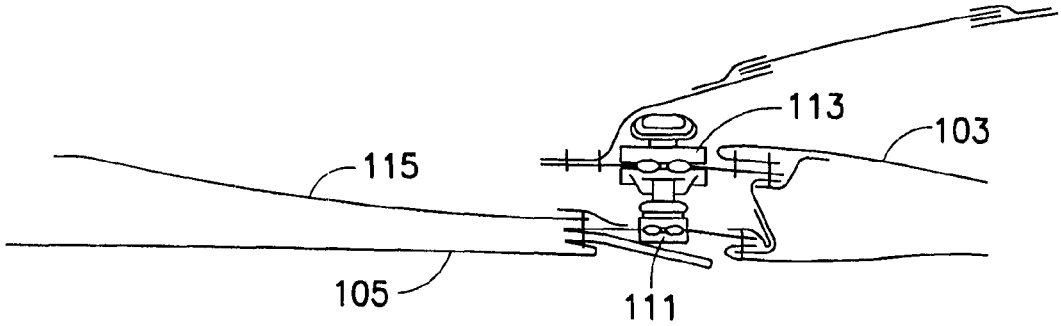
Figure 15:
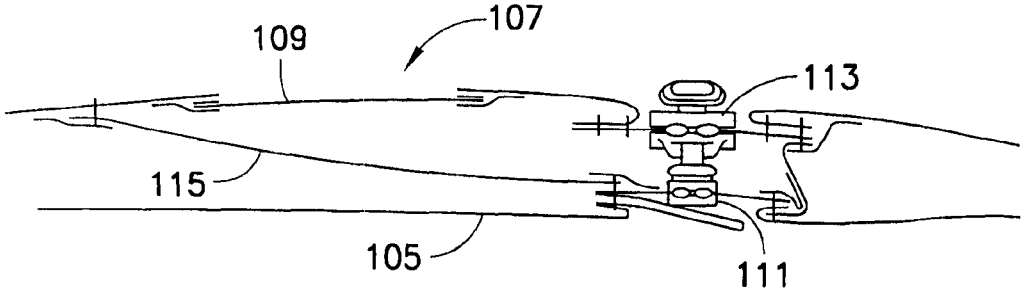
Figure 16:
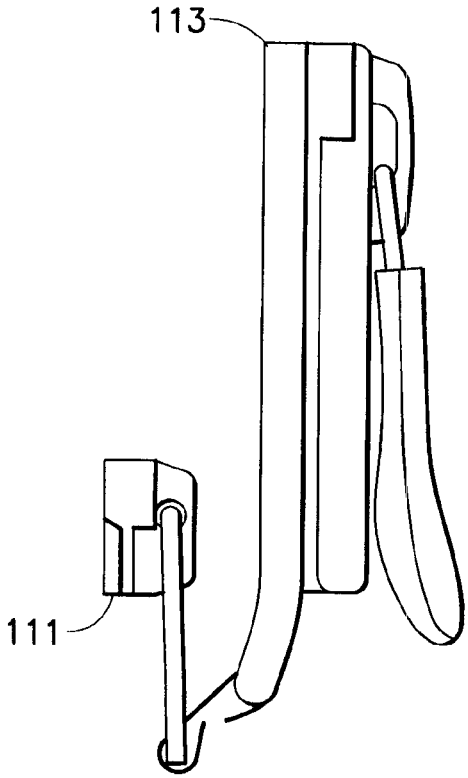
FIG. 16 shows a side view of the adjusting mechanism clipped to the zipper slide.
Figure 17:
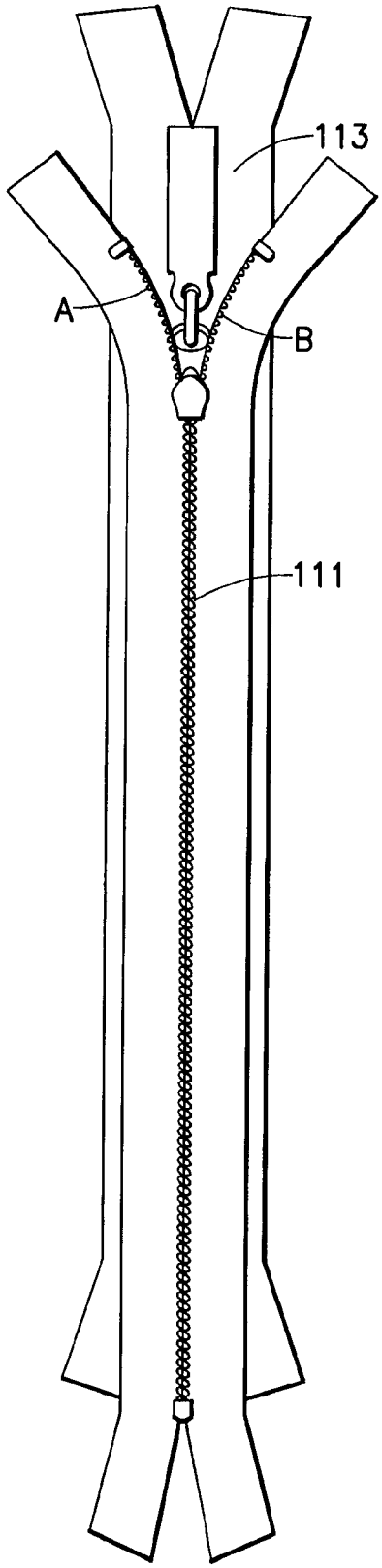
FIG. 17 shows an underside view of the adjusting mechanism clipped to the zipper slide.

As seen in FIGS. 3-5, vented jacket 100 may include removable hood 103A.

Referring now to FIGS. 11-15, a method of constructing a venting assembly according to an embodiment of the present invention is shown. As seen in these Figs., zipper 111 may be stitched to inner liner 105, carrier 117, vent back 115 and taped. Adjusting mechanism may then be stitched to outer shell 103, carrier 117 and taped. Screen 109 may then be glued into a die-cut hole in outer shell 103, that is, to cover vent 107 (screen 109 may be taped to stabilize). Outer shell 103 in the area of vent 109 may be stitched to adjusting mechanism 113 and adjusting mechanism 113 may be connected to the slide of zipper 111 (e.g., via a metal or plastic clip, loop, hook, ring or the like). Finally, vent back 115 may be stitched to shell goods and taped. Additional construction of apparel or other item (e.g., adding insulation) may be carried out.

Figure 20:
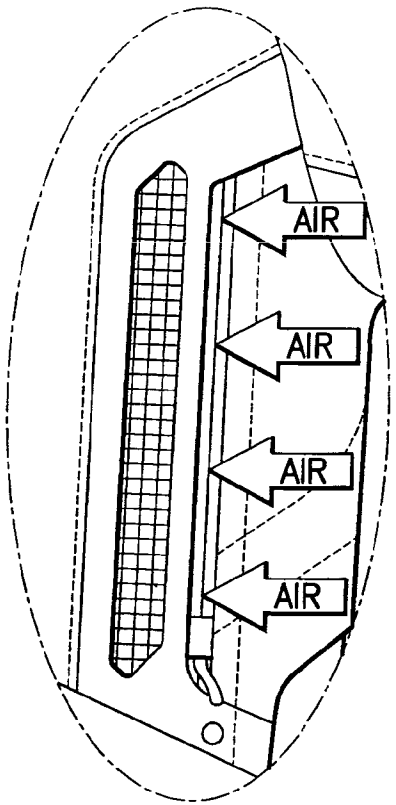
FIGS. 18-20 show diagrams related to operating the adjusting mechanism and the associated air flow according to an embodiment of the present invention.
Figure 19:
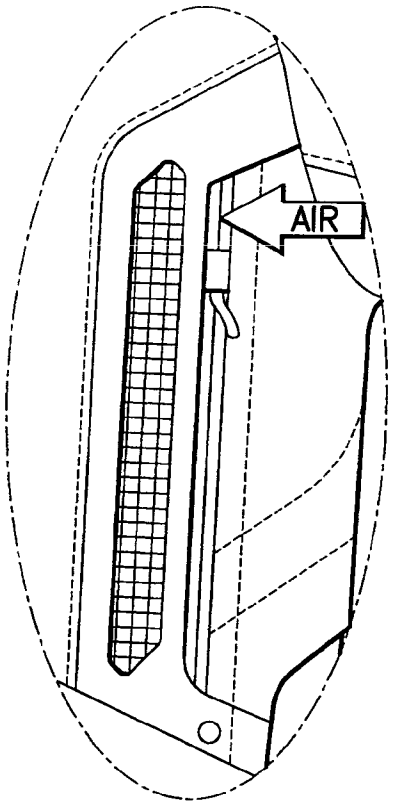
Figure 18:
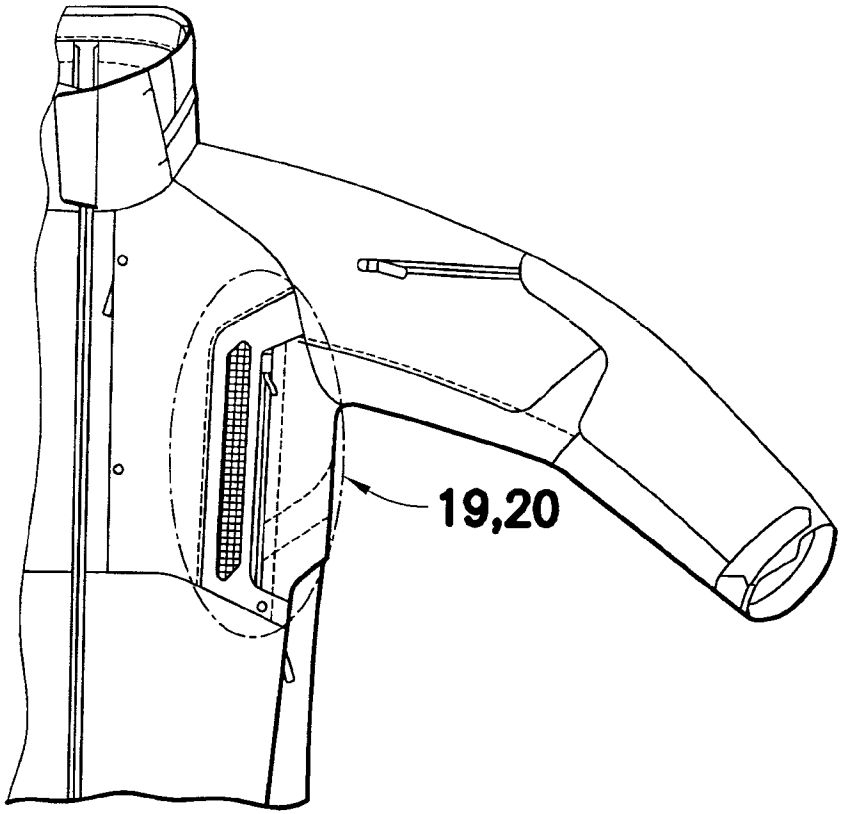
Figure 23:
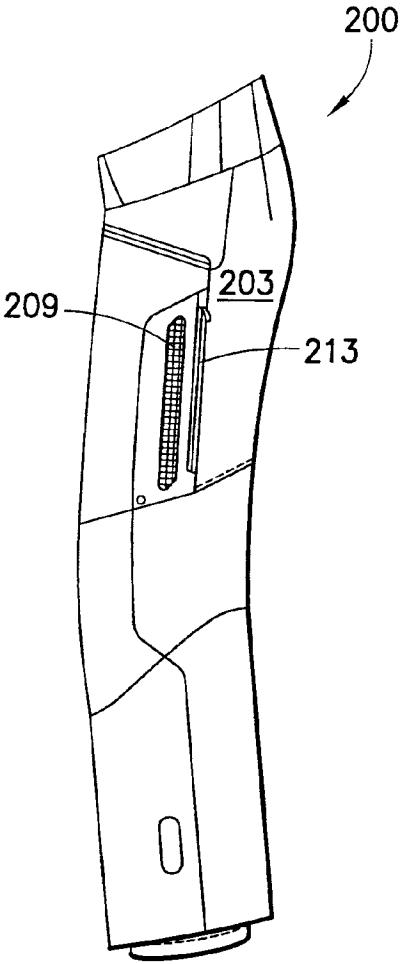
FIG. 23 shows a side view of the vented pair of pants of FIG. 21.
Figure 21:
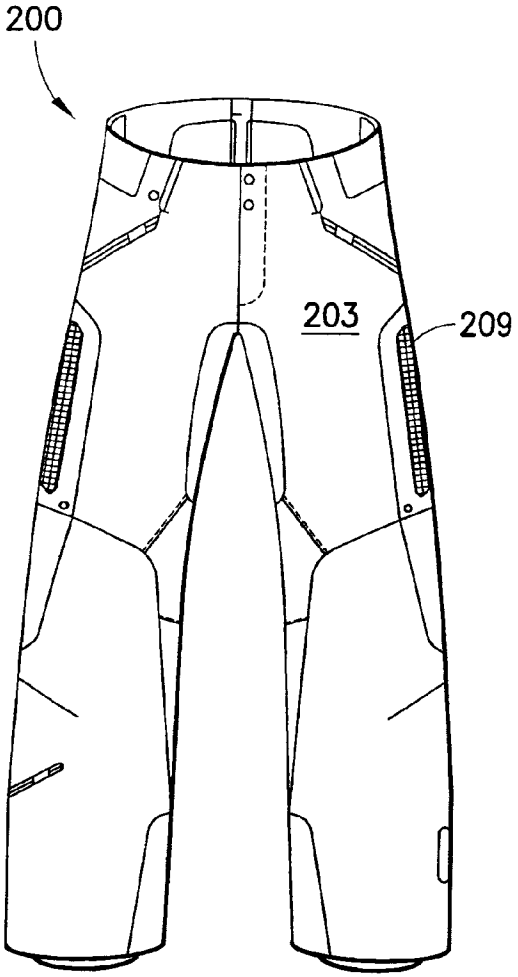
FIG. 21 shows a front view of a vented pair of pants according to one embodiment of the present invention.
Figure 25:
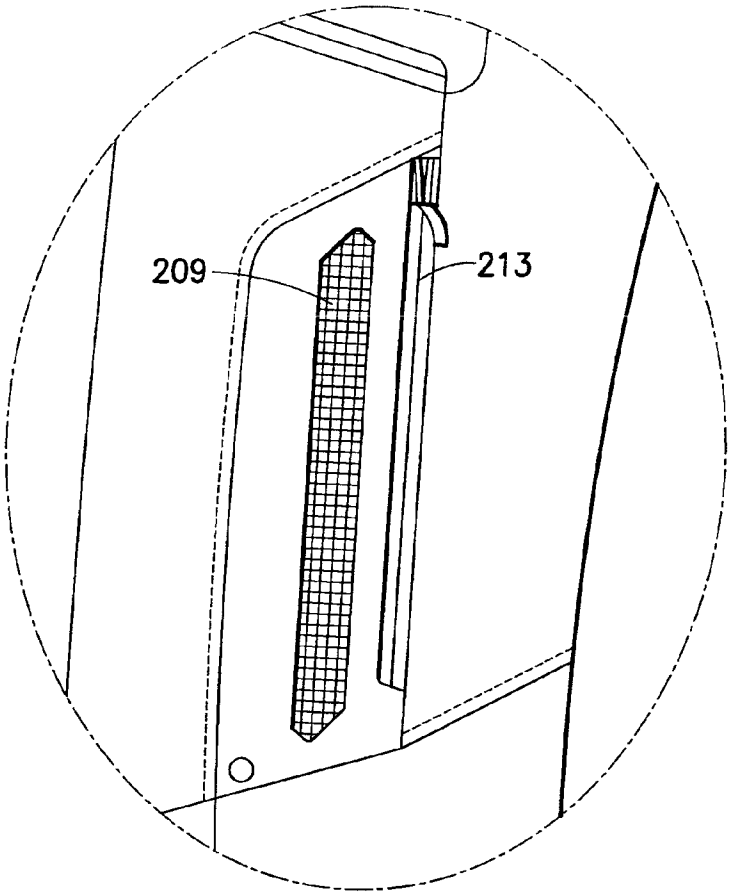
FIG. 25 shows certain details of one of the venting assemblies of the vented pair of pants of FIG. 24.
Figure 24:
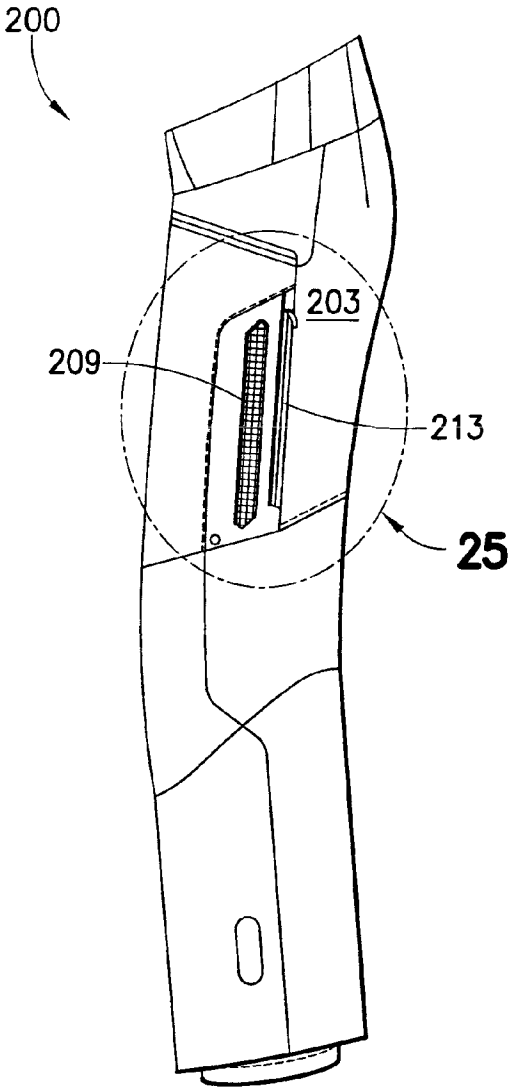
FIG. 24 shows another side view of the vented pair of pants of FIGS. 21-23.

Referring now to FIGS. 18-20, diagrams directed to the operation of the adjusting mechanism and associated air flow are shown.

As seen in these Figs., at stage 1, the adjusting mechanism is shown in the fully closed position. The adjusting mechanism of this embodiment does not open to the outside. Also, in this position the zipper connected to the adjusting mechanism substantially prohibits air from flowing through the vent between the outside of the outer shell and the inside of the inner liner.

At stage 2, the adjusting mechanism is shown open slightly. Thus, the connected zipper is also open slightly. In this configuration, only a small amount of air is permitted to flow through the vent between the outside of the outer shell and the inside of the inner liner.

At stage 3, the adjusting mechanism is show open at its maximum. Thus, the connected zipper is also open at its maximum. In this configuration, the maximum amount of air is permitted to flow through the vent between the outside of the outer shell and the inside of the inner liner.

Of course, the adjusting mechanism (and connected zipper) may be opened and closed to permit any desired amount of airflow Referring now to FIGS. 21-25, various views of a vented pair of pants according to an embodiment of the present invention are shown. The pair of pants of these Figs. may utilize venting assemblies similar in construction and operation to those of the vented jacket of FIGS. 1-20. In particular, pants 200 may include outer shell 203 and an inner liner (not shown) disposed adjacent at least a portion of an inside of outer shell 203. Vent 207 may be provided through outer shell 203, wherein vent 207 is substantially covered by screen 209. Further, a zipper (not shown) may be provided on the inner liner and adjusting mechanism 213 may be provided on outer shell 203 (of note, certain elements of a venting assembly of this embodiment comprising vent 207, screen 209 and adjusting mechanism 213 are identified herein by callout numbers—however, any desired number of venting assemblies may be utilized (see, for example, FIG. 21 depicting the front of the pants having a left hand side venting assembly and a right hand side venting assembly).

While a number of embodiments of the present invention have been described, it is understood that these embodiments are illustrative only, and not restrictive, and that many modifications may become apparent to those of ordinary skill in the art. For example, any desired number of venting assemblies may be utilized for any given apparel or item. Further, the venting assemblies may be placed anywhere desired on the apparel or item. Further still, in the case of multiple venting assemblies, each venting assembly may be operated independently or one or more venting assemblies may be operated in an interdependent manner Further still, any number of additional conventional vents may be provided as desired to aid in airflow. Further still, the outer shell may be of a soft material (e.g., in the case of a jacket, a pair of pants or soft-sided luggage) or the outer shell may be of a hard material (e.g., in the case of a helmet or hard-sided luggage). Further still, the various steps may be carried out in any desired order (and any desired steps may be added and/or any desired steps may be eliminated).

What is claimed is:

1. A vented apparel, comprising:

an outer shell;

an inner liner disposed adjacent at least a portion of an inside of the outer shell;

a vent through the outer shell, wherein the vent is substantially covered by a screen;

a zipper on the inner liner; and an adjusting mechanism on the outer shell;

wherein the adjusting mechanism is connected to the zipper in order to move the zipper between a closed position and an open position;

wherein the zipper, in the open position, permits air to flow through the vent and the screen between an outside of the outer shell and an inside of the inner liner;

wherein the zipper, in the closed position, substantially prohibits air from flowing through the vent and the screen between the outside of the outer shell and the inside of the inner liner;

wherein the adjusting mechanism is configured to be actuated to move the zipper between the closed position and the open position;

wherein the zipper moves between the closed position and the open position without creating an opening in the outer shell; and wherein the screen is at least partially exposed regardless of whether the zipper is in the open position or the closed position and regardless of a position of the adjusting mechanism.

2. The vented apparel of claim 1, wherein the apparel is selected from the group consisting of: (a) a jacket; (b) a coat; (c) a pair of pants, (d) a shirt; (e) a glove; (f) a hat; and (g) a hood.

3. The vented apparel of claim 1, wherein the adjusting mechanism is a second zipper.

4. The vented apparel of claim 3, wherein the second zipper comprises a slide, a first row of teeth and a second row of teeth, wherein the first row of teeth and the second row of teeth are substantially all interconnected when the slide is at a first end of the second zipper, wherein the first row of teeth and the second row of teeth are substantially all interconnected when the slide is at a second end of the second zipper, and wherein movement of the slide along the length of the second zipper from one side to the other results in the first row of teeth and the second row of teeth remaining substantially all interconnected.

5. The vented apparel of claim 3, wherein the second zipper is water resistant regardless of the position of the slide of the second zipper.

6. The vented apparel of claim 3, wherein the second zipper is formed from a material selected from the group consisting of: (a) metal; and (b) plastic.

7. The vented apparel of claim 1, wherein the zipper is water resistant in the closed position.

8. The vented apparel of claim 1, wherein the zipper is formed from a material selected from the group consisting of: (a) metal; and (b) plastic.

9. The vented apparel of claim 1, wherein the screen is a perforated nylon fabric.

10. The vented apparel of claim 1, further comprising a vent back disposed between the screen and the zipper for directing the air to flow through the vent and the screen between an outside of the outer shell and an inside of the inner liner.

11. A vented apparel, comprising:

an outer shell;

an inner liner disposed adjacent at least a portion of an inside of the outer shell;

a vent through the outer shell, wherein the vent is substantially covered by a screen;

a zipper on the inner liner; and an adjusting mechanism on the outer shell;

wherein the adjusting mechanism is connected to the zipper in order to move the zipper between a closed position and an open position;

wherein the zipper, in the open position, permits air to flow through the vent and the screen between an outside of the outer shell and an inside of the inner liner;

wherein the zipper, in the closed position, substantially prohibits air from flowing through the vent and the screen between the outside of the outer shell and the inside of the inner liner;

wherein the adjusting mechanism is configured to be actuated to move the zipper between the closed position and the open position without the adjusting mechanism creating an opening in the outer shell;

wherein the adjusting mechanism is a second zipper comprising a slide, a first row of teeth and a second row of teeth, wherein the first row of teeth and the second row of teeth are substantially all interconnected when the slide is at a first end of the second zipper, wherein the first row of teeth and the second row of teeth are substantially all interconnected when the slide is at a second end of the second zipper, and wherein movement of the slide along the length of the second zipper from one side to the other results in the first row of teeth and the second row of teeth remaining substantially all interconnected; and wherein the screen is at least partially exposed regardless of whether the zipper is in the open position or the closed position and regardless of a position of the adjusting mechanism.

12. The vented apparel of claim 11, wherein the apparel is selected from the group consisting of: (a) a jacket; (b) a coat; (c) a pair of pants, (d) a shirt; (e) a glove; (f) a hat; and (g) a hood.

13. The vented apparel of claim 11, wherein the zipper is water resistant in the closed position.

14. The vented apparel of claim 11, wherein the zipper is formed from a material selected from the group consisting of: (a) metal; and (b) plastic.

15. The vented apparel of claim 11, wherein the second zipper is water resistant regardless of the position of the slide and the second zipper.

16. The vented apparel of claim 11, wherein the second zipper is formed from a material selected from the group consisting of: (a) metal; and (b) plastic.

17. The vented apparel of claim 11 wherein the screen is a perforated nylon fabric.

18. The vented apparel of claim 11, further comprising a vent back disposed between the screen and the zipper for directing the air to flow through the vent and the screen between an outside of the outer shell and an inside of the inner liner.

* * * * *